United States Patent [19]

Dewar et al.

[11] 3,954,646

[45] May 4, 1976

[54] DISINFECTANT COMPOSITION AND METHOD

[75] Inventors: Norman Ellison Dewar, St. Louis; Said Ibrahim Raziq, Ferguson, both of Mo.

[73] Assignee: Chemed Corporation, Cincinnati, Ohio

[22] Filed: May 7, 1974

[21] Appl. No.: 467,686

[52] U.S. Cl. ..... 252/106; 252/107

[51] Int. Cl.[2] ..... C11D 3/48

[58] Field of Search ..... 252/106, 107; 424/167, 424/315, 317, 318, 365; 260/526 S, 539 R, 408

[56] References Cited

UNITED STATES PATENTS

| | | | |
|---|---|---|---|
| 2,199,397 | 5/1940 | Engelmann | 260/501 |
| 2,240,275 | 4/1941 | Whitmore et al. | 260/539 |
| 2,245,610 | 6/1941 | Schaffer et al. | 260/539 X |
| 2,266,992 | 12/1941 | Roblin | 424/317 |
| 2,681,363 | 6/1954 | Schwenk et al. | 260/521 |
| 2,729,586 | 1/1956 | Peck | 424/317 |
| 3,160,555 | 12/1964 | Hamill et al. | 424/346 X |
| 3,275,505 | 9/1966 | Herschler | 424/317 |
| 3,867,300 | 2/1975 | Karabinos | 252/106 |

FOREIGN PATENTS OR APPLICATIONS

| | | |
|---|---|---|
| 508,738 | 1/1955 | Canada |

OTHER PUBLICATIONS

Goepfert et al., "Effect of Volatile Fatty Acids of *Salmonella typhimurium*," J. Bacteriology, Vol. 97, No. 2, 1969.

*Primary Examiner*—P. E. Willis, Jr.
*Attorney, Agent, or Firm*—Eugene M. Bond

[57] ABSTRACT

The invention disclosed provides new improved liquid detergent-germicide compositions and a method of using same. Generally, anti-microbially active alpha-halogenated fatty acid is combined with an anionic surface active agent and a monobasic and/or hydroxy monobasic organic acid. In a preferred embodiment, the anti-microbially active alpha-halogenated fatty acid is an alpha-brominated fatty acid.

6 Claims, No Drawings

DISINFECTANT COMPOSITION AND METHOD

This invention relates to a liquid detergent-germicide composition having an anti-microbially active alpha-halogenated fatty acid disposed in combination with an anionic surface active agent and a member of the group consisting of monobasic organic acid, hydroxy monobasic organic acid and combination thereof. The present invention also relates to a method for using these new compositions.

Many disinfectant compositions are well-known to the art with a great majority comprising aqueous solutions or emulsions of phenolic derivatives or quaternary ammonium salts. However, these known disinfectant compositions suffer from a variety of disadvantages among which is poor biocidal activity against certain microorganisms, reduction in effectiveness by proteinaceous matter or specific inactivators and relatively high toxicity.

The use of aliphatic monocarboxylic acids as anti-microbial agents is also well-known to the art. In general, they possess germicidal activity against both gram positive and gram negative bacteria but are deficient in fungicidal activity.

It has now been found that by the practice of the present invention, certain low cost halogenated fatty acids may be combined with an anionic surface active agent and a monobasic organic acid and/or hydroxy monobasic organic acid in preparing a superior detergent-germicide composition that does not depend on commonly used phenolic or quaternary germicidal species and yet has a significant broad spectrum anti-microbial activity in aqueous solutions, a relatively low toxicity factor and a pleasant, non-objectionable odor. The present compositions are also found to be useful for commercial, industrial and general use where anti-microbial activity is required along with significant cleansing properties. These compositions may be prepared as a liquid concentrate which is readily diluted for use.

Practice of the present invention is based on the discovery that the anti-microbial potency of aliphatic monocarboxylic acids can be substantially upgraded by alpha-halogenation, preferably alpha-bromination, to the extent that germicidal activity against gram positive and gram negative bacteria is at least doubled and good fungicidal activity is obtained.

Broadly stated, the liquid detergent-germicide compositions of the present invention include, in combination, an anti-microbially active alpha-halogenated fatty acid, preferably alpha-brominated fatty acid, an anionic detergent which is preferably biodegradable and a member of the group consisting of monobasic organic acid hydroxy monobasic organic acid and combination thereof.

Halogenated fatty acid used herein has the following general formula:

$$R[CHX]COOH$$

Wherein X is Cl, Br, or I and R is an alkyl group ranging from 1 to about 16 carbon atoms in length. The optimum germicidal properties of these halogenated fatty acids occur in the alkyl chain length range of about 6 to about 12 carbon atoms.

The monobasic and/or hydroxy monobasic organic acid component of the present composition enhances the anti-microbial activity and stabilizes the pH of the use solution of the present invention when exposed to alkaline surfaces during end use.

The anionic detergent provides surface tension lowering and wetting characteristics on surfaces as well as good cleaning properties.

The concentrated compositions are clear, stable liquids which form effective detergent-germicide solutions on dilution with water. The concentrated compositions are also stable to temperature changes, thus resisting the tendency of the active components to precipitate when subjected to freezing. The present detergent-germicide compositions are found to have significant activity in hard water as well as distilled water, a relatively low toxicity and the absence of the pungent fatty acid odor which can be objectionable when these compositions are made with non-halogenated fatty acids. The composition of the present invention is found to be highly effective against a variety of common microorganisms such as *Staphylococcus aureus*, *Salmonella choleraesuis*, *Pseudomonas aeruginosa*, *Mycobacterium tuberculosis*, and *Trichophyton interdigitale*. The effectiveness of the present composition depends upon the particular combination of materials, the concentration of ingredients used and the nature of the particular microorganism. The concentrated detergent-germicide compositions of this invention may contain from 1 part to about 36 parts of alpha-halogenated fatty acid by weight, from about 2 parts to about 30 parts by weight of an anionic detergent which is preferably biodegradable and from 1 part to about 20 parts monobasic organic acid, hydroxy monobasic organic acid, or combination of such acids.

Preferably, the present concentrate detergent-germicide composition includes about 2 parts to about 16 parts by weight of alpha-halogenated fatty acid, about 2 parts to about 12 parts by weight of the anionic detergent and about 2 parts to about 14 parts by weight of the monobasic organic acid and/or hydroxy monobasic organic acid. Concentrated, i.e. non-use concentrated forms of the present composition may have a pH of about 1 to about 5. In normal use solutions, wherein the active alpha-halogenated fatty acid comprises about 0.02 to about 0.16 percent by weight, the pH may range from about 2 to about 6.

The first component of the present invention is aliphatic monocarboxylic acid halogenated on the alpha carbon, preferably brominated. Examples of such halogenated fatty acids which either separately or in combination may form the halogenated fatty acid component of the present detergent-germicide composition include alpha-bromo butyric acid, alpha-bromo valeric acid, alpha-bromo capric acid, alpha-bromo caprylic acid, alpha-bromo caproic acid, alpha-bromo pelargonic acid, alpha-bromo decanoic acid, alpha-bromo undecylenic acid, and alpha-bromo lauric acid.

A second principal component of the present detergent-germicide composition is an anionic surface active agent, preferably biodegradable. A great number of the detergents useful in the present invention are listed in McCutchen's Detergent and Emulsifiers 1973 Annual (John W. McCutchen Inc., Morristown, N.J., 1973). Especially preferred detergents used in the practice of the present invention are the ammonium or sodium salts of sulfated, ethoxylated or unethoxylated, primary or secondary, natural or synthetic fatty alcohols (Steol CS 460, Steol CA 460 by Stepan Chemical Co.; Tergitol 15-S-3A, Tergitol 15-S-3S by Union Carbide Corporation; Maprofix NH, Maprofix LK by Millmaster Onyx Corporation) and also alkyl benzene sulfonic acid (Calsoft 99, by Pilot Chemical Co.)

A third component of the present detergent-germicide composition is monobasic organic acid, hydroxy monobasic organic acid, or combinations thereof. Examples of such acids which either separately or in combination may form the acidic, pH stabilizing component of the present composition include acetic acid, hydroxy acetic acid, propionic acid, and lactic acid.

Known low molecular weight primary or secondary alcohols and glycols may be used, if desired, as solvents in the manufacture of the present detergent germicide composition. Examples of these solvent components include hydroxy alkylamines such as triethanolamine; polyglycol ethers such as propylene glycol monomethyl ether; glycols such as 2-methyl-2,4-pentanediol; and alcohols such as ethanol or isopropanol. When added, these solvent materials may be present in the concentrated detergent-germicide compositions in an amount from about 5 to about 20 parts by weight with amounts within the range from about 6 to about 12 parts by weight being preferred. Corrosion retardants such as benzyltriazole (Cobratec 99, by Sherwin Williams Co.), chelating agents such as citric acid, and perfuming materials may also be included in the present composition is desired using suitable and adequate amounts.

Practice of the present invention is more fully illustrated by the following non-limiting examples wherein all amounts unless otherwise indicated are amounts by weight:

EXAMPLE 1

The following ingredients in amounts indicated were combined by mixing to form a detergent-germicide composition:

| | |
|---|---|
| Sodium salt of coconut fatty Alcohol ether sulfate (Steol CS 460 (60%) by Stepan Chemical Co.) | 10.00 |
| Isopropanol | 12.00 |
| Cobratec 99 (Sherwin Williams Co.) | 00.40 |
| Glycolic Acid (70%) | 10.00 |
| Alpha-bromo pelargonic acid | 08.00 |
| Citric acid | 10.00 |
| Triethanolamine | 2.50 |
| Soap aroma 10-VES-709 | 0.50 |
| Soft Water | 46.60 |

The following observations were made for the prepared composition:

TABLE 1

| DETERMINATION | OBSERVATION |
|---|---|
| Stability for 6 months | |
| at room temperature | Good & commercially acceptable |
| at 5°C | Good & commercially acceptable |
| at 50°C | Good & commercially acceptable |
| pH of Concentrate | 2.1 |
| pH of 1:64 deionized water dilution | 2.6 |

Bacteriological evaluation of the Example 1 composition in accordance to the 11th edition of the Official AOAC Use-Dilution Confirmation Test and Fungicidal Test in 400 ppm hard water yielded the following results:

TABLE 2

| Use-Dilution | *S. aureus* | *Ps. aeruginosa* | *T. interdigitale* 5 min. | 10 min. | 15 min. |
|---|---|---|---|---|---|
| 1:64 | 0/60 | 0/60 | – | – | – |
| 1:128 | 0/60 | 0/60 | – | – | – |

EXAMPLE 2

The procedure of Example 1 was repeated except that the alphabrominated pelargonic acid was substituted with unbrominated pelargonic acid, using equivalent amounts.

Bacteriological evaluation of the Example 2 composition in accordance to Official AOAC Testing Procedures in 400 ppm hard water yielded the following results:

TABLE 3

| Use-Dilution | *S. aureus* | *Ps. aeruginosa* | *T. interdigitale* 5 min. | 10 min. | 15 min. |
|---|---|---|---|---|---|
| 1:64 | 0/60 | 3/60 | + | + | + |
| 1:128 | 8/60 | 6/60 | + | + | + |

As can be seen from the comparison of bacteriological data of these examples, the presence of the alphabrominated pelargonic acid in Example 1 has substantially improved the germicidal activity of the composition and has reduced the cost of producing such a system by doubling the use-dilution at which an effective germicidal activity still can be maintained and has rendered the composition fungicidal.

EXAMPLE 3

The following components in the amounts indicated were combined by mixing to form a detergent-germicide concentrate composition:

| Ingredients | Parts by Weight |
|---|---|
| Sodium salt of coconut fatty alcohol Ether sulfate (Steol CS 460, by Stepan Chemical Co. 60%) | 10.00 |
| Isopropanol | 10.00 |
| Glycolic Acid (70%) | 10.00 |
| Citric Acid | 10.00 |
| Alpha-bromo octanoic acid | 8.00 |
| Cobratec 99 (Sherwin Williams Co.) | 0.40 |
| Liquid Cleaner Bouquet Lime No. 17 | 0.25 |
| Soft Water | 51.35 |

The following observations were made for the prepared composition of Example 3:

TABLE 4

| DETERMINATION | OBSERVATION |
|---|---|
| Stability for 6 months | |
| at room temperature | Good and commercially acceptable |
| at 5°C | Good and commercially acceptable |
| at 50°C | Good and commercially acceptable |
| pH of concentrate | 2.0 |
| pH of 1:64 deionized water dilution | 2.4 |

Bacteriological evaluation of the composition of Example 3 in accordance to the 11th edition of Official AOAC Testing Procedures in 400 ppm hard water yielded the following results:

TABLE 5

| Use-Dilution | *S. aureus* | *Ps. aeruginosa* | *T. interdigitale* 5 min. | 10 min. | 15 min. |
|---|---|---|---|---|---|
| 1:64 | 0/60 | 0/60 | - | – | – |
| 1:128 | 0/60 | 0/60 | – | – | – |

EXAMPLE 4

The procedure of Example 3 was repeated, except that alpha-brominated Neofat 330 fatty acid ($C_8$—32%, $C_{10}$—25%, $C_{12}$—40% by Armour Chemical Co.) was substituted in equal amount in place of alpha-bromo octanoic acid. This composition was found to have the same germicidal effectiveness as the composition of Example 3.

EXAMPLE 5

The procedure for Example 1 was repeated, except that the glycolic acid and citric acid components were reduced to 50% of their concentration in Example 1. This composition has shown the same stability characteristics and germicidal effectiveness against *S. Aureus*, *Ps. aeruginosa* and *Trichophyton interdigitale*.

EXAMPLE 6

The procedure of Example 1 was repeated, except that alpha-bromo pelargonic acid was substituted with alpha-bromo coconut fatty acid using the same amount. This composition has shown the same stability characteristics and germicidal effectiveness as Example 1.

It is understood that the foregoing detailed description is given merely by way of illustration and that many variations may be made therein without departing from the spirit of this invention.

What is claimed is:

1. A liquid detergent-germicide composition consisting essentially of, in combination, an anti-microbially active alpha-halogenated fatty acid, an anionic surface active agent and a monobasic organic acid selected from the group consisting of acetic acid, hydroxy acetic acid, propionic acid, latic acid and combinations thereof, said anti-microbially active alpha-halogented fatty acid having the formula:

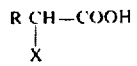

wherein X is a member selected from the group consisting of chlorine, bromine and iodine, and R is an alkyl group of 1 to 16 carbon atoms, and wherein the relative amounts are from 1 part to about 36 parts by weight of alpha-halogenatd fatty acid, from about 2 parts to about 30 parts by weight of anionic detergent and from 1 part to about 20 parts by weight of said monobasic acid.

2. The liquid detergent-germicide composition of claim 1 wherein the alkyl group is from about 6 to about 12 carbon atoms.

3. The liquid detergent-germicide composition of claim 1 comprising about 2 parts to about 16 parts by weight of alpha-halogenated fatty acid, about 2 parts to about 12 parts by weight of the anionic detergent and about 2 parts to about 14 parts by weight of the monobasic organic acid, the composition having a pH of about 1 to about 5.

4. The liquid detergent-germicide composition of claim 1 wherein the halogenated fatty acid is selected from the group consisting of alpha-bromo butyric acid, alpha-bromo valeric acid, alpha-bromo capric acid, alpha-bromo caprylic acid, alpha-bromo caproic acid, alpha-bromo pelargonic acid, alpha-bromo decanoic acid, alpha-bromo undecylenic acid, and alpha-bromo lauric acid.

5. The liquid detergent-germicide composition of claim 1 wherein the anionic surface active agent is selected from the group consisting of ammonium or sodium salts of sulfated, ethoxylated or unethoxylated, primary or secondary, natural or synthetic fatty alcohols; and alkyl benzene sulfonic acid.

6. A method for retarding growth of microorganisms selected from the group consisting of *Staphylococcus aureus*, *Salmonella choleraesuis*, *Pseudomonas aeruginosa*, *Mycobacterium tuberculosis*, and *Trichophyton interdigitale*, which comprises, applying a use-dilution solution of the concentrate of claim 1, said use-dilution having an active alpha-halogenated fatty acid concentration of about 0.02 to about 0.16% by weight and a pH in the range of about 2 to about 6.

* * * * *